US009539487B2

(12) United States Patent
Henry

(10) Patent No.: US 9,539,487 B2
(45) Date of Patent: Jan. 10, 2017

(54) MULTI-MATERIAL IMPACT PROTECTION FOR CONTACT SPORTS

(71) Applicant: Nike, Inc., Beaverton, OR (US)

(72) Inventor: Ryan P. Henry, Beaverton, OR (US)

(73) Assignee: Nike, Inc., Beaverton, OR (US)

( * ) Notice: Subject to any disclaimer, the term of this patent is extended or adjusted under 35 U.S.C. 154(b) by 738 days.

(21) Appl. No.: 13/795,269

(22) Filed: Mar. 12, 2013

(65) Prior Publication Data

US 2014/0259322 A1 Sep. 18, 2014

(51) Int. Cl.
*A63B 71/12* (2006.01)

(52) U.S. Cl.
CPC ..... *A63B 71/12* (2013.01); *A63B 71/1225* (2013.01); *A63B 2071/125* (2013.01); *A63B 2071/1241* (2013.01); *A63B 2243/007* (2013.01)

(58) Field of Classification Search
CPC . A63B 71/12; A63B 71/1225; A63B 71/1241; A63B 2071/125; A63B 2243/007
See application file for complete search history.

(56) References Cited

U.S. PATENT DOCUMENTS 2,818,571 A * 1/1958 Grant ..... A41D 13/0506 2/22
3,735,419 A * 5/1973 Byrd ..... A63B 71/1225 2/22
4,648,554 A 3/1987 McQueen
6,490,730 B1 * 12/2002 Lyden ..... A41D 13/0153 2/22
7,082,621 B1 * 8/2006 Fratesi ..... A41D 13/0158 2/227
8,245,842 B2 8/2012 Bau
2003/0154540 A1 * 8/2003 Nishimoto ..... A63B 71/1225 2/220
2010/0293703 A1 11/2010 Tezartes-Strauss

FOREIGN PATENT DOCUMENTS

EP 1334667 8/2003
EP 2525187 A1 11/2012
WO 2007078743 7/2007

OTHER PUBLICATIONS

International Search Report with Written Opinion dated Jul. 8, 2014 in Application No. PCT/US14/21309, 14 pages.
International Preliminary Report on Patentability dated Sep. 24, 2015 in Application No. PCT/US2014/21309, 7 pages.
Chinese Search Report dated Jan. 4, 2016 in Application No. 201480013286.5, 2 pages.
Chinese Office Action dated Jan. 12, 2016 in Application No. 201480013286.5, 7 pages.

* cited by examiner

*Primary Examiner* — Shaun R Hurley
*Assistant Examiner* — Andrew W Sutton
(74) *Attorney, Agent, or Firm* — Shook, Hardy & Bacon L.L.P.

(57) ABSTRACT

A protective device may be configured to be worn to protect a portion of a wearer's anatomy. A pliable first material may form a perimeter portion and at least one connecting portion. A rigid second material may form at least two plates retained within the perimeter portion and at least one connecting portion.

19 Claims, 6 Drawing Sheets

MULTI-MATERIAL IMPACT PROTECTION FOR CONTACT SPORTS

CROSS-REFERENCE TO RELATED APPLICATIONS

Not applicable.

FIELD

The present invention relates to athletic safety and injury prevention. More particularly, the present invention relates to an impact protection device to be worn by an athlete participating in a contact sport, such as American football.

SUMMARY

Many sports, such as American football, inherently involve physical contact between players, with the ground, and/or with equipment. Numerous efforts have been made to prevent or at least reduce the occurrence of injuries to players as a result of such contact. Protective equipment such as helmets, shoulder pads, and pads have been used for protecting portions of the body of athletes. Such protective equipment has often been constructed, at least in part, of a compressible material such as foam. These types of equipment have decreased, but not completely eliminated, injuries occurring due to playing and/or practicing contact sports such as American football.

The use of protective equipment has been mandated by various organizations that promulgate the rules of contact sports for participants. Often, the very athletes at risk for injury resist the use of additional protective equipment, whether mandatory or voluntary. While every individual athlete may have his or her own reason for eschewing required or suggested protective gear, common explanations are complaints that the protective gear is uncomfortable, restricts motion, distracts the athlete, or otherwise negatively impacts the athlete's performance. Accordingly, athletes participating in contact sports with a risk of injury may benefit from improved protective gear that protects the athlete from injury with minimal or no negative impact on the athlete's performance. Such protective gear should be comfortable and permit a full range of movement by the wearer, while still providing sufficient connection from impacts that may typically occur during participation in the sport.

A protective device in accordance with the present invention provides improved impact protection for athletes participating in contact sports such as American football, soccer (world football), hockey, lacrosse, or any other contact sport permitting participants to wear protective gear. A protective device in accordance with the present invention may be particularly suitable for protecting large muscle areas of the wearer from impact, but may be used to protect other portions of a wearer's anatomy without departing from the scope of the present invention. One example of a large muscle area that may be protected using a device in accordance with the present invention are the thighs of an American football player. A protective device in accordance with the present invention may comprise a multi-material plate curved to correspond to the shape of the anatomical portion of the wearer to be protected when the plate is worn. A protective device in accordance with the present invention may have a complex three dimensional shape to better conform to the anatomical portion to be protected, but may have a simpler shape without departing from the scope of the present invention. Such shape, whether complex or simple, may be attained by processes such as molding, machining, additive manufacturing, etc. A protective device in accordance with the present invention may be retained in a desired as worn position by inserting it into a pocket of a garment worn during participation in a sport, using wraps or tape, with adhesives, etc. A protective device in accordance with the present invention may have an inward face that is oriented toward the skin of a wearer in an as worn position and an outward face that is oriented away from the skin of the wearer in an as worn position.

A protective device in accordance with the present invention may comprise at least two different types of materials having different properties. For example, a first material may be softer and more flexible than a second material. In such an example, the harder second material may comprise more than half, more than three quarters, more than eighty percent, and/or more than ninety percent of the outward face to increase the likelihood that an impact on the anatomical portion of the wearer protected by the device will be initially absorbed by the harder second material. In this example, the first material may be disposed around the perimeter of a protective plate to provide an edge that will engage with the wearer's skin whether directly or through intermediate layers, without causing the level of discomfort likely if the harder and more rigid second material were to engage the wearer's skin.

Further, a protective device in accordance with the present example of the invention may comprise multiple interior regions or plates of the harder and more rigid second material joined by connecting regions formed at least in part of the first material. Connecting tabs of the second material may additionally connect plates through the more pliable first material of a connecting region to enhance the structural integrity of the protective device. The connecting regions of the softer and more pliable first material with only a limited number of connecting tabs of the more rigid second material may permit the entire protective device to flex and/or bend, thereby enhancing the comfort to the wearer and facilitating donning of the protective device. The number, width, and/or thickness of such connecting tabs may vary based upon the amount of flexibility or structural rigidity desired at a connecting region. Plates of the rigid second material may have ridges, valleys, and/or other dimensional structures formed on their surface(s). Structures may be formed on plate surfaces through molding, machining, or any other process. Such ridges and/or valleys may further enhance the structural integrity of a plate. Further, ventilation holes may extend through plates to increase the comfort of the protective device for the wearer. Ventilation holes if used, may extend through valleys formed on the surface of a plate, and may be formed as part of the molding of the plate, formed by drilling, etc.

The shape and size of a protective device in accordance with the present invention may vary based upon the portion of the wearer's anatomy intended to be protected by the device, the size and/or gender of the athlete wearing the protective device, the sport for which the protective device is to be used, the degree or amount of protection desired, comfort considerations, mobility or flexibility considerations, aesthetic desires, etc. Different regions or zones of a protective device may have varying sizes and/or orientations. For example, a protective device in accordance with the present invention may protect the thigh of an athlete when worn, and may have at least two zones of a harder second material and a perimeter and at least one connecting portion of a softer first material. In such an example, the zones formed of the second material may extend in a substantially vertical fashion, a substantially horizontal fashion, a substantially diagonal fashion, and/or in a substantially checker board fashion. Different zones formed of the same type of material need not be the same size or have the same orientation relative to the perimeter portion and/or the anatomy of the wearer when the protective device is worn.

Further, more than two types of materials may be used to form a protective device in accordance with the present invention. For example, a protective device in accordance with the present invention may comprise an outward facing surface having a softer first material, a harder second material, and a yet harder third material oriented to improve impact protection, flexibility, comfort, etc. Further, additional materials may be added to a protective device in accordance with the present invention for any purpose. For example, additional materials may be used: to provide additional protection, such as a resilient layer on at least a portion of the outward face; to further enhance comfort, such as a moisture management layer on at least a portion of the inward face; to facilitate wear, such as connection points to secure the protective device in an as worn position; to enhance the structural integrity of the protective device, such as ribs or other structural elements; and the like.

Protective devices in accordance with the present invention may be formed in a variety of fashions. One example of a suitable fabrication method for forming protective devices in accordance with the present invention is co-molding processes that sequentially forms regions of the device from the various materials used to provide protection to a wearer. However, components formed of one or more material may be formed separately and then assembled to form a protective device in accordance with the present invention. For example, a first component may comprise a perimeter and connecting portion formed via molding or cutting of a pliable first material, and independently formed second components comprising plates of a harder second material may be inserted into the appropriate portions of the first component. Further, additive manufacturing techniques, such as 3-D printing and/or laser sintering, may be used to fabricate protective devices in accordance with the present invention.

DRAWINGS

The drawings described herein are for illustrative purposes only of selected

DETAILED DESCRIPTION

Figure 1:
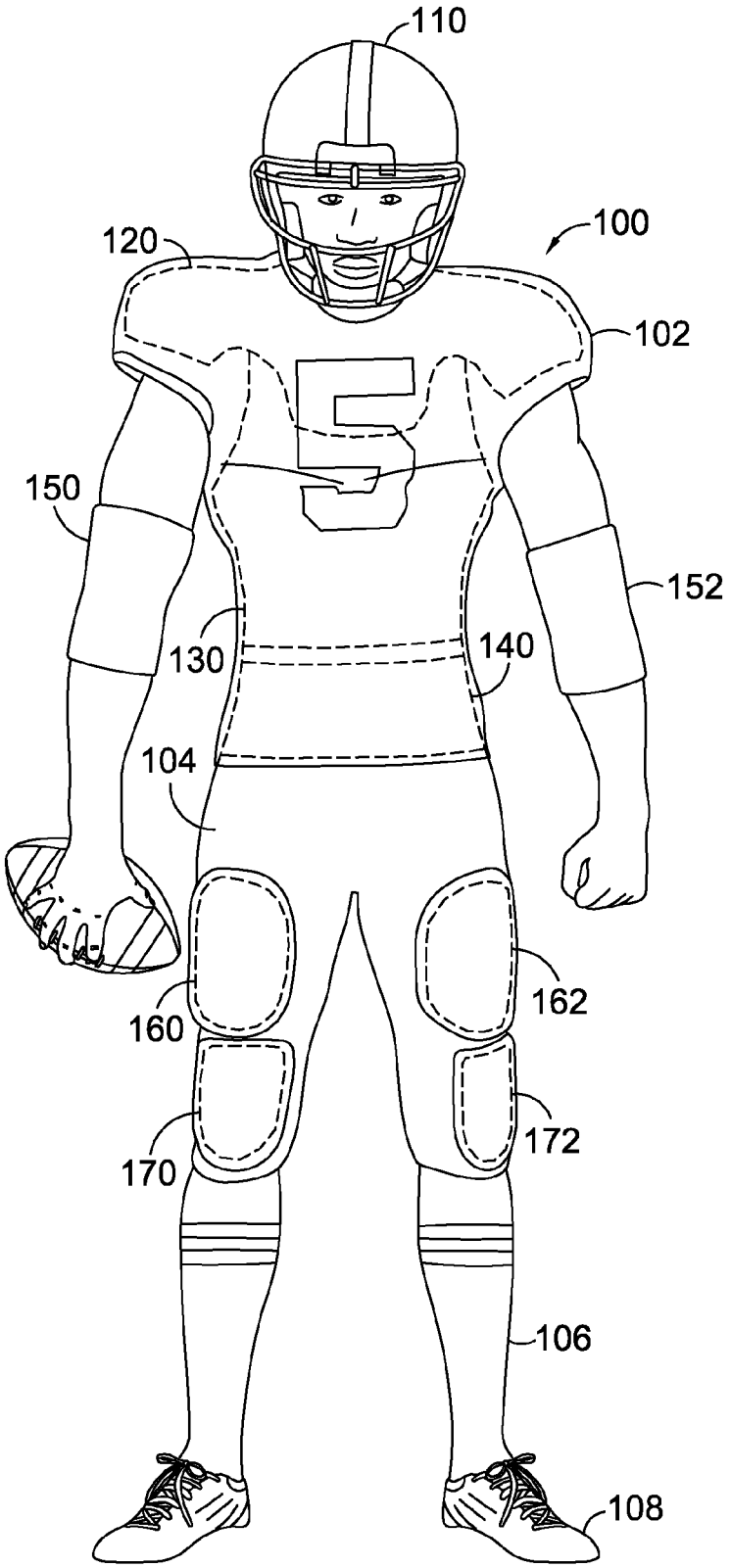
FIG. 1 illustrates a football player that may wear a protective device in accordance with the present invention.

Referring now to FIG. 1, an athlete 100 wearing protective gear is illustrated. In the example shown in FIG. 1, the athlete 100 is an American football player, but athletes participating in any other contact sport may likewise benefit from protective devices in accordance with the present invention. Player 100 is shown wearing a helmet 110 and shoulder pads 120 beneath a jersey 102. In the example shown in FIG. 1, player 100 is also wearing chest protection 130, which may comprise a flak jacket or similar item, and abdominal protection 140 beneath jersey 102. Player is further illustrated wearing a right elbow pad 150 and a left elbow pad 152. Player 100 is also wearing a right thigh pad 160 and a left thigh pad 162 and a right knee pad 170 and a left knee pad 172 beneath pants 104. Pants 104 may have pockets (not shown) on either the outside or, more typically, the inside to retain pads such as thigh pads 160, 162 and knee pads 170, 172. Player 100 is further shown wearing shoes 108 and socks 106. While not currently typical in American football, socks 106 may retain additional pads such as a shin pad (not shown) as more commonly occurs for soccer.

While the example shown in FIG. 1 depicts an American football player 100 wearing specific examples of protective devices, the present invention is not limited to American football or the protective devices illustrated in the present example. Subsequent examples described below provide effective devices that may be used as thigh pads 160, 162, but protective devices in accordance with the present mention may be used in conjunction with other types of protection provided in the example shown in FIG. 1 or to protect portions of the wearer's anatomy other than those shown in the example of FIG. 1.

Figure 2A:
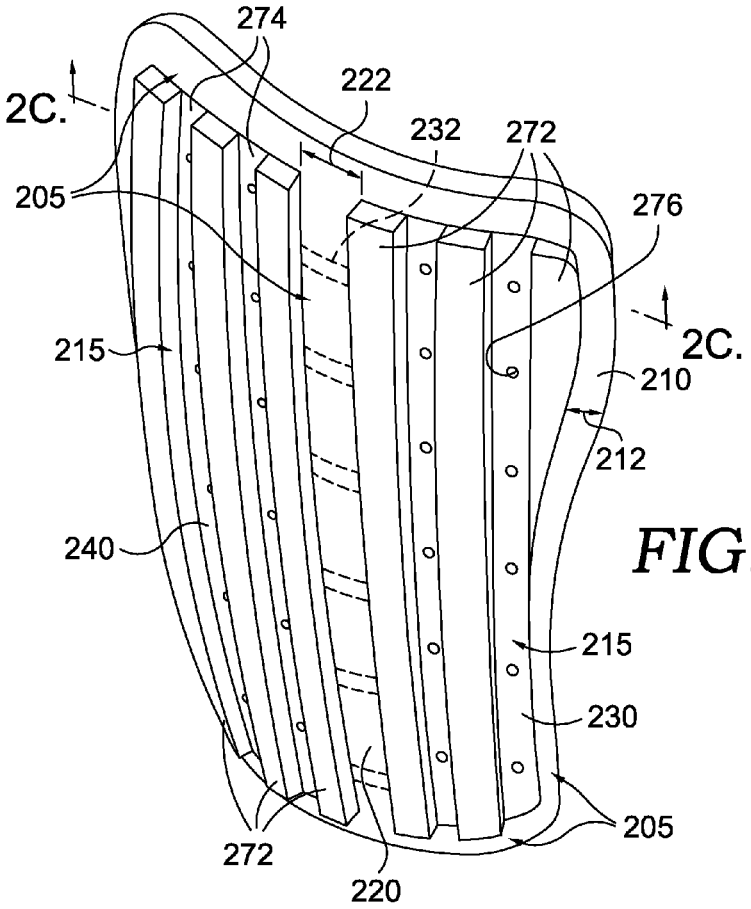
FIGS. 2A-2B illustrate various perspective views of an example of a protective device in accordance with the present invention.
Figure 2B:
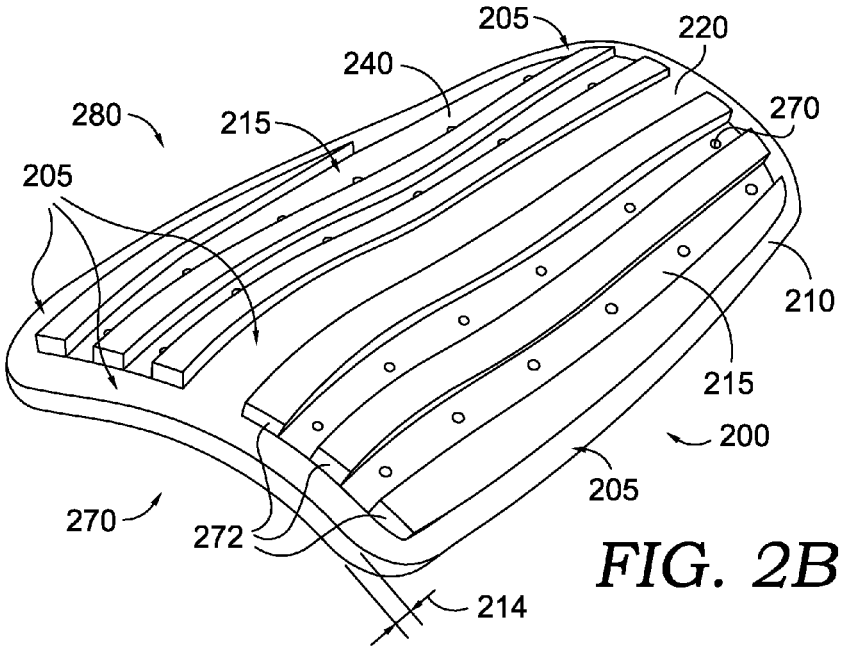
Figure 2C:
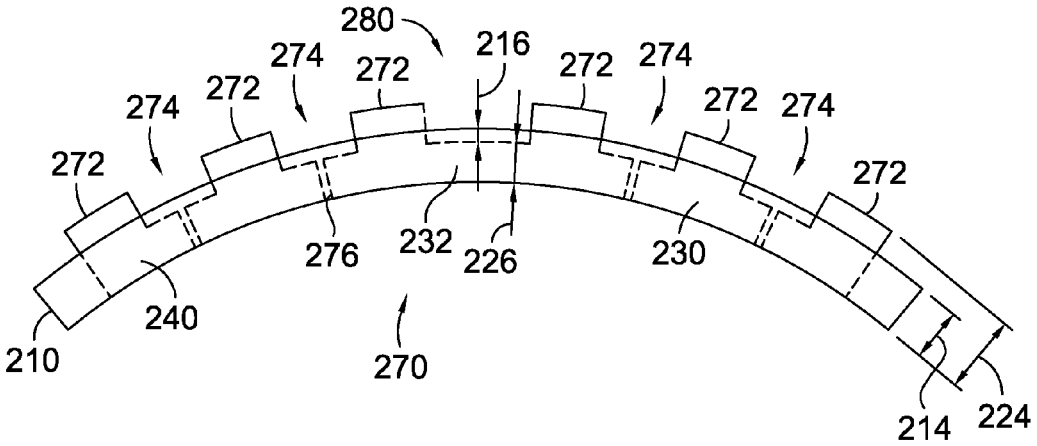
FIG. 2C illustrates a cross sectional view of the example protective device shown in FIGS. 2A-2B.

Referring now to FIGS. 2A-2C, an example of a protective device 200 in accordance with the present invention is illustrated. The example protective device 200 is particularly adapted to protect a thigh of an American football player, but protective devices in accordance with the present invention may be used to protect other portions of a wearer's anatomy and/or for sports other than American football. Protective device 200 has an inward face 270 that faces the skin of the wearer in an as worn position and an outward face 280 that faces away from the skin of the wearer in an as worn position. As can be particularly seen in FIG. 2C, inward face 270 may have a concave shape adapted to fit comfortably over a portion of the wearer's anatomy, in this example a thigh. The degree of concavity and/or the shape of curve formed by inward face 270 may vary at different locations along the protective device 200 to better conform to the varying contour expected at different positions along the portion of the wearer's anatomy to be protected by protective device 200, resulting in a complex three dimensional shape, i.e., horizontal cross sections of a protective device 200 may have different sizes and shapes at different locations along a vertical axis of the protective device 200 and the shape or contour of protective device 200 may also be different at different locations offset horizontally. Further, the size, shape, and/or configuration of a protective device may differ if it is intended for a particular side of a wearer's anatomy. For example, a protective device may have different curvature, shape, or configuration of elements depending upon whether it is intended to protect the left or right thigh of wearer. Similar differences may arise for protective devices intended to protect portions of a wearer's anatomy other than a thigh.

In the example of FIGS. 2A-2C, a first material portion 205 comprise a perimeter portion 210 and a connecting portion 220. As can be seen in FIG. 2A, perimeter portion 210 may form a terminal edge of protective device 200. Perimeter portion 210 may have a first width 212, and connecting portion 220 may have a second width 222. While first width 212 of the perimeter portion 210 and/or second width 222 of the connecting portion 220 may be substantially the same at all locations along perimeter portion 210 and/or connecting portion 220, this need not be the case. The first width 212 and second width 222 may be measured in a direction substantially parallel to the portion of the wearer's anatomy protected when protective device 200 is worn. For example, first width 212 may vary around perimeter portion 210 to provide more or less of the first material at different locations along the edge of the protective device 200. First width 212 and second width 222 may be the same or different.

A second material 215 may be used to form a first plate 230 and a second plate 240, both of which are retained within the first material portion 205 comprising perimeter portion 210 and connecting portion 220. A plurality of connecting tabs 232 may connect first plate 230 to second plate 240 across, beneath, and/or through connecting portion 220. Tabs 232, first plate 230, and second plate 240 may be formed integrally of the second material 215, but may also be formed independently. In some examples of protective devices in accordance with the present invention, connecting tabs 232 may be omitted entirely. Tabs 232 may be below connecting portion 220 and/or contained within connecting portion 220. Each of first plate 230 and second plate 240 may have a plurality of ridges 272 and corresponding valleys 274 to provide additional strength to the second material 215. Ridges 272 and valleys 274 may extend in a substantially parallel fashion vertically, horizontally, and/or diagonally in an as worn position. Further, if present, ridges 272 and/or valleys 274 need not be parallel or even linear. Ridges 272 may extend above the surface of first material 205, but may extend to be level or even below the surface of first material 205. Further, valleys 274 may extend below the surface of first material 205, but may be below or level with surface of first material 205. A plurality of ventilation holes 276 may extend through second material 215, and may be located within the valleys 274 of first plate 230 and second plate 240. As can be seen from FIGS. 2A and 2B, at least fifty percent of outward face 280 of protective device 200 may comprise portions made from the second material 215, in the present example the first plate 230 and the second plate 240. In further examples, outward face 280 of protective device 200 may comprise at least eighty percent or at least ninety percent of the second material 215. The second material 215 used to form the first plate 230 and the second plate 240 may be formed of relatively hard materials such as, but not limited to, some types of nylon, acrylonite butadiene styrene (ABS), polypropylene, plastic, rubber, other types of polymers, or other materials. The first material 205 used to form perimeter portion 210 and connecting portion 220 may comprise a relatively soft and pliable material, such as a rubber, thermoplastic elastomers (TPE), thermoplastic polyurethane (TPU), other types of polymers, etc. Additionally/alternatively, a protective device 200 in accordance with the present invention may be fabricated using additive manufacturing methodologies, such as 3-D printing or laser sintering, in which case first material 205 and second material 215 may be selected from materials suitable for those methods. The absolute hardness of the first material 205 and the second material 215 may vary depending upon the type of impact(s) a protective device 200 in accordance with the present invention is expected to encounter during use, but generally the first material 205 may be softer and more pliable the second material 215, while the second material 215 may be harder and more rigid than the first material 205. In this way, the second material 215 may resist deformation from impact, but the softer first material 205 of perimeter portion 210 may distribute any transmitted force over the edge of the protective plate 200 without painfully engaging the underlying anatomy of the wearer.

As can be seen in FIGS. 2B and 2C, in perimeter portion 210 the first material 205 may have a first thickness 214 as measured substantially perpendicular to the anatomical portion of the wearer protected when protective device 200 is worn. The distance of first thickness 214 may vary based upon the material selected for first material and the type and/or force of impact(s) anticipated during the use of protective device 200. The second material 215 of first plate 230 and/or second plate 240 may have a second thickness 224 at a thickest point corresponding to a ridge 272 and a third thickness 226 at a thinnest point corresponding to a valley 274. Second thickness 224 and third thickness 226 may vary, for example, based upon the material selected for second material 215 and the type and/or force of impact(s) anticipated during the use of protective device 200. In the example cross sectional view illustrated in FIG. 2C taken along line 2C of FIG. 2A, the first thickness 214 of the first material 205 is less than the second thickness 224 of the second material 215 but greater than third thickness 226 of second material 215. However, first thickness 214, second thickness 224, and third thickness 226 may vary from these examples without departing from the scope of the present invention. As shown in FIG. 2C, tabs 232 are covered on the external side 280 of protective device 200 with the first material 205 of connecting portion 220. In this example, connecting tabs 232 and valleys 274 comprise the same third thickness 220 of the second material 215, but they may also have different thicknesses.

As can be seen in the examples of FIGS. 2A and 2B, connecting portion 220 may join first plate 230 and second plate 240. The pliable first material 205 of connecting portion 220 and connecting tabs 232 joining first plate 230 and second plate 240 permit the overall protective device 200 to flex along connecting portion 220 even if the second material 215 comprising first plate 230 and second plate 240 is too rigid to permit easy flexing or bending. Accordingly, the protective device 200 may be worn without causing discomfort to the wearer and without significantly limiting the mobility of the wearer with rigid protective materials.

Figure 3:
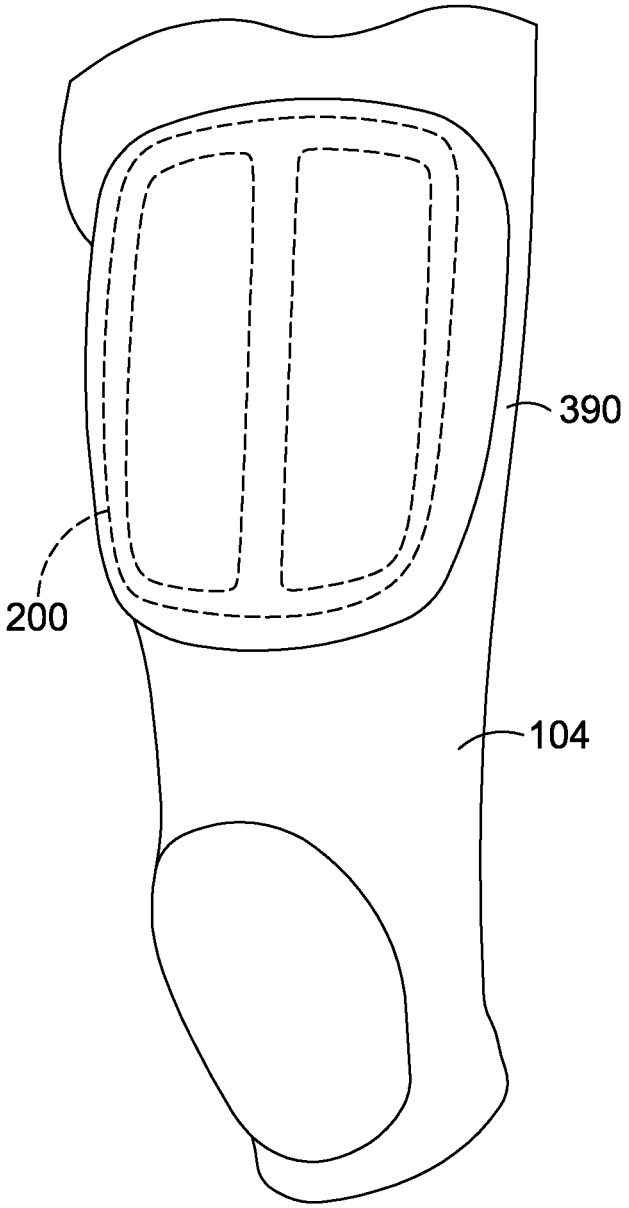
FIG. 3 illustrates an example of the exemplary device of FIGS. 2A-2C in an as worn position.

Referring now to FIG. 3, an example of a protective device 200 in an as worn position is shown. In the example of FIG. 3, protective device 200 comprises an example thigh pad as described above with regard to FIGS. 2A-2C, but other protective devices in accordance with the present invention, some examples of which are further described below, may similarly be worn as shown in the example of FIG. 3, or in other fashions. As can be seen in the example of FIG. 3, protective device 200 may be retained within pants 104 to be positioned over the thigh 390 of an American football player. Protective device 200 may be retained in a pocket within pants 104, for example, but may be retained in other fashions or at other locations to protect different portions of the wearer's anatomy when worn.

Figure 4:
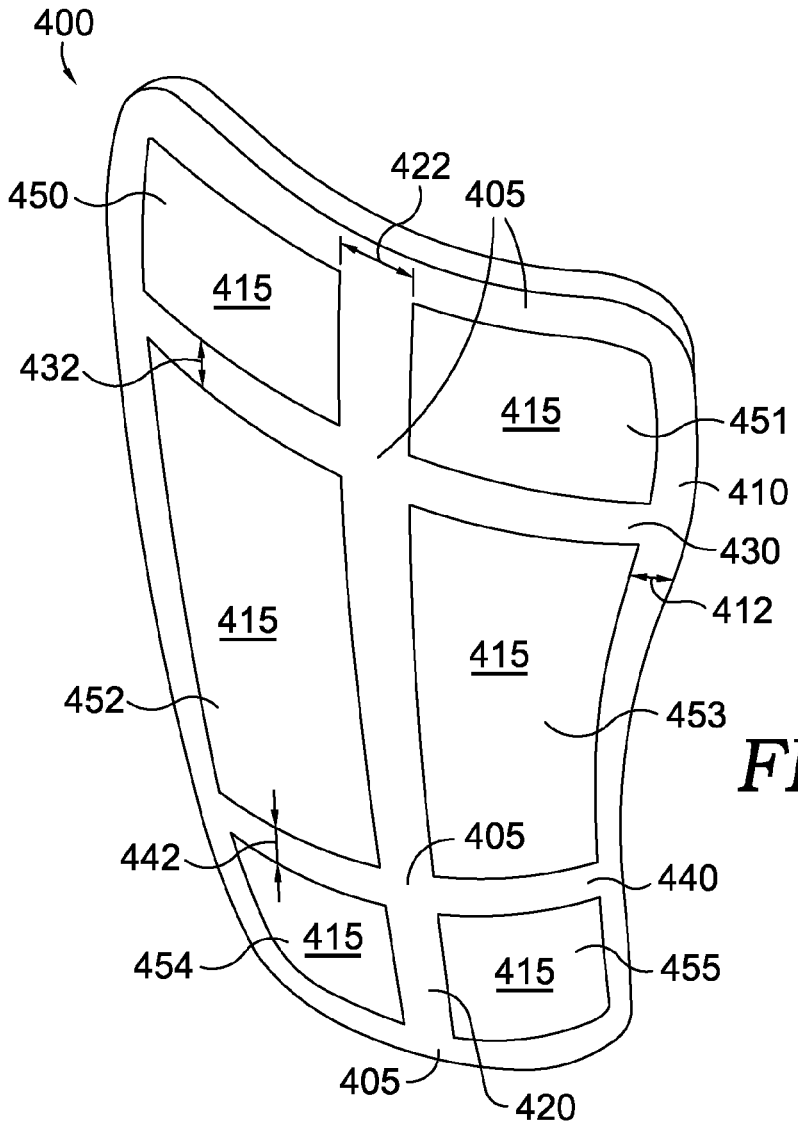
FIG. 4 illustrates a further example of a protective device in accordance with the present invention.

Referring now to FIG. 4, an additional example of a protective device 400 in accordance with the present invention is shown. Protective device 400 may comprise a thigh pad, or may be adapted to fit and protect other portions of a weearer's anatomy. A first material 405 portion may comprise perimeter portion 410 may have a first width 412. Further, first material 405 portion may have a vertical connecting portion 420 having a second width 422, a first horizontal connecting portion 430 having a third width 432, and a second horizontal connecting portion 440 having a fourth width 442. The first width 412, second width 422, third width 432, and/or fourth width 442 may be the same or different and may optionally vary at different positions on protective device 400. Protective device may further comprise a plurality of protective plates 450, 451, 452, 453, 454, 455 of a second material 415 and retained within perimeter portion 410 and/or one or more of connecting portions 420, 430, 440 of protective device 400. As explained above with regard to FIGS. 2A-2C, the first material 405 and second material 415 may be selected to possess different degrees of hardness and/or other properties to comfortably protect a wearer of the protective device 400. As described above with regard to FIGS. 2A-2C, tabs may connect plates of the second material 415, which may also have ridges, valleys, and/or ventilation holes.

Figure 5:
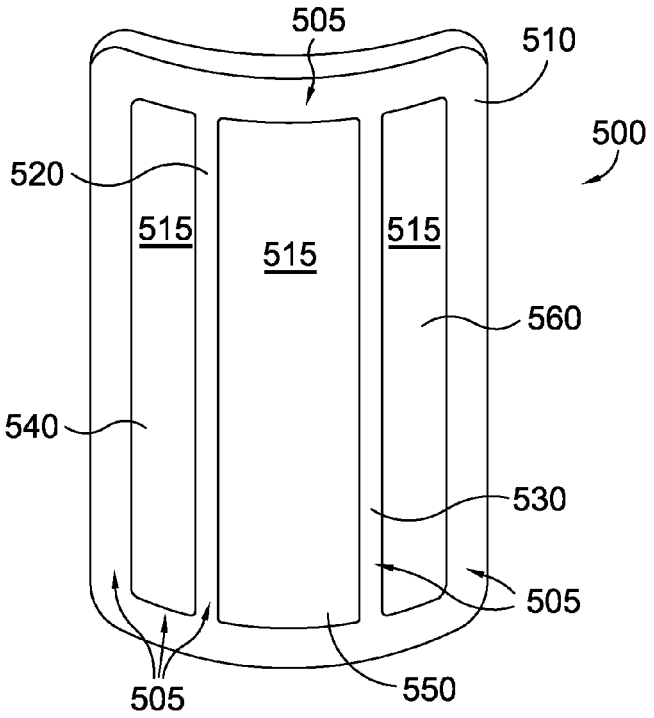
FIG. 5 illustrates yet a further example of a protective device in accordance with the present invention.

Referring now to FIG. 5, a further example of a protective device 500 in accordance with the present invention is illustrated. Protective device 500 may comprise a perimeter portion 510, a first vertical connecting portion 520, and a second vertical connecting portion 530 formed from a first material 505. Protective device 500 may further comprise a first plate 540, a second plate 550, and a third plate 560 retained formed from a second material 515 and retained within the perimeter portion 510 and/or one of more of the first vertical connecting portion 520 and the second vertical connecting portion 530. As explained above with regard to FIGS. 2A-2C, the first material 505 and second material 515 may be selected to possess different degrees of hardness and/or other properties to comfortably protect a wearer of the protective device 500, may have connecting tabs, ridges, valleys, and/or ventilation holes.

Figure 6:
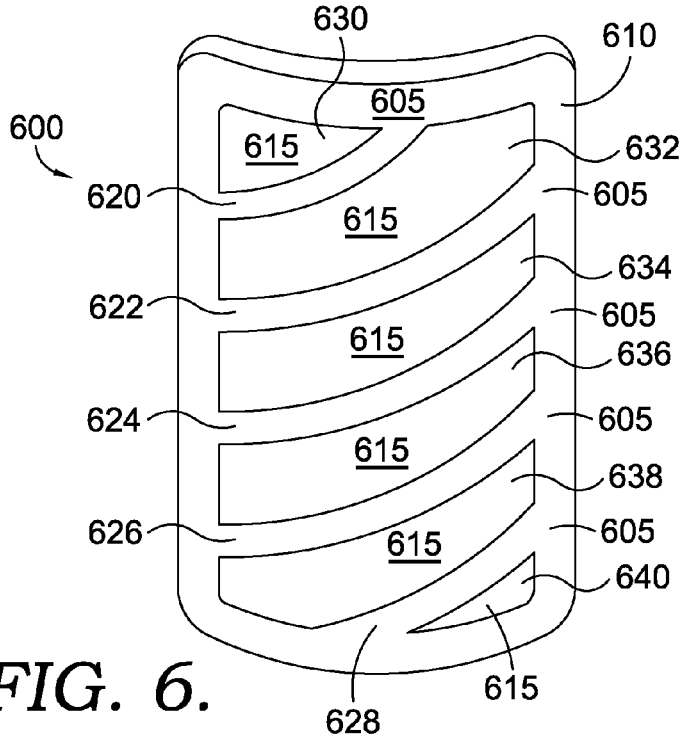
FIG. 6 illustrates yet a further example of a protective device in accordance with the present invention.

Yet a further example of a protective device 600 in accordance with the present invention is illustrated in FIG. 6. Protective device 600 may comprise a first material 605 that forms a perimeter portion 610 and a plurality of diagonal connecting portions 620, 622, 624, 626, 628. Protective device 600 may further comprise a plurality of plates 630, 632, 634, 636, 638, 640 formed of a second material 615 and retained within a subset of the perimeter portion 610 and the plurality of diagonal connecting portions 620, 622, 624, 626, 628. As explained above with regard to FIGS. 2A-2C, the first material 605 and second material 615 may be selected to possess different degrees of hardness and/or other properties to comfortably protect a wearer of the protective device 600, may have connecting tabs, ridges, valleys, and/or ventilation holes.

The wide variety of possible configurations of a first material into at least a perimeter portion and optionally a plurality of connecting portions having any desired orientation to retain at least one plate of a second material permits protective devices in accordance with the present invention to be used to protect a wide variety of body parts of athletes with various genders and body types while engaging in any type of sport. While described with regard to a thigh pad for use in American football in examples herein, protective devices in accordance with the present invention are not limited to any particular configuration, anatomical portion to be protected, and/or sport.

What is claimed is:

1. A protective device for attenuating force from an impact, the protective device comprising:

an impact plate comprising:

a first plate portion having an anterior surface, a posterior surface, and a first thickness between the anterior surface and the posterior surface of the first plate portion;

a second plate portion having an anterior surface, a posterior surface, and a second thickness between the anterior surface and the posterior surface of the second plate portion; and a connecting tab that extends between and bridges the first plate and the second plate, the connecting tab having an anterior surface, a posterior surface, and a third thickness between the anterior surface and the posterior surface of the connecting tab, the third thickness being less than the first thickness and the second thickness; and an elastomeric member that is more pliable than the impact shell and that includes a connecting portion that covers the anterior surface of the connecting tab.

2. The protective device of claim 1, further comprising a plurality of connecting tabs integrally formed of a same material as the first plate portion and the second plate portion, the plurality of connecting tabs extending between the first plate portion and the second plate portion.

3. The protective device of claim 1, wherein the first plate portion and the second plate portion each includes a plurality of ridges and a plurality of valleys extending in a substantially parallel fashion.

4. The protective device of claim 3 wherein the protective device has a convex outward face and wherein more than fifty percent of the convex outward face includes the impact plate.

5. The protective device of claim 4 wherein the elastomeric member is constructed of a thermoplastic elastomer.

6. The protective device of claim 4 wherein the elastomeric member is constructed of a thermoplastic polyurethane.

7. The protective device of claim 4 wherein the elastomeric member is constructed of a rubber.

8. The protective device of claim 4 wherein the impact plate is constructed of a nylon.

9. The protective device of claim 4 wherein the impact plate is constructed of acrylonite butadiene styrene.

10. The protective device of claim 4 wherein the impact plate is constructed of polypropylene.

11. A protective device for attenuating force from an impact, the device comprising:

at least two plate portions including a first plate portion and a second plate portion, the at least two plate portions formed of a first material;

one or more connecting tabs that connects the first plate portion to the second plate portion;

an elastomeric perimeter portion that binds terminal edges of the at least two plate portions and forms a terminal perimeter edge of the protective device, the elastomeric perimeter portion formed of a second material that is more pliable than the first material; and at least one elastomeric connecting portion extending between two points on the elastomeric perimeter portion, the elastomeric connecting portion covering at least a portion of the connecting tab, the elastomeric connecting portion formed from the first material.

12. The protective device of claim 11, wherein the at least one elastomeric connecting portion comprises a plurality of connecting portions.

13. The protective device of claim 11, wherein the at least one elastomeric connecting portion extends horizontally in an as worn position.

14. The protective device of claim 11, wherein the at least one elastomeric connecting portion extends vertically in an as worn position.

15. The protective device of claim 11, wherein the at least one elastomeric connecting portion extends diagonally in an as worn position.

16. The protective device of claim 11 wherein the second material comprises at least one of a thermoplastic elastomer, a thermoplastic polyurethane, and a rubber.

17. The protective device of claim 16 wherein the first material comprises at least one of a nylon, acrylonite butadiene, and polypropylene.

18. The protective device of claim 17 wherein the first material and the second material have been fabricated by molding to have a complex three dimensional shape that is configured to conform to the portion of the wearer's anatomy to be protected.

19. The protective device of claim 11 wherein the first material and the second material have been fabricated by an additive manufacturing process to have a complex three dimensional shape that is configured to conform to the portion of the wearer's anatomy to be protected.

* * * * *